US012065800B2

(12) United States Patent
Zhu et al.

(10) Patent No.: US 12,065,800 B2
(45) Date of Patent: Aug. 20, 2024

(54) METHOD FOR CONSTRUCTION OF COMPOSITE UNDER-REAMED PILE AND EQUIPMENT THEREOF

(71) Applicants: Bo Zhu, Guangdong (CN); Junyi Pei, Tianjin (CN)

(72) Inventors: Bo Zhu, Shenzhen (CN); Xiaofeng Pei, Tianjing (CN); Junyi Pei, Tianjin (CN); Luning Zhu, Shenzhen (CN)

(73) Assignees: Bo Zhu, Shenzhen (CN); Junyi Pei, Tianjin (CN)

( * ) Notice: Subject to any disclaimer, the term of this patent is extended or adjusted under 35 U.S.C. 154(b) by 207 days.

(21) Appl. No.: 17/779,086

(22) PCT Filed: Dec. 18, 2019

(86) PCT No.: PCT/CN2019/126283
§ 371 (c)(1),
(2) Date: May 23, 2022

(87) PCT Pub. No.: WO2021/103209
PCT Pub. Date: Jun. 3, 2021

(65) Prior Publication Data

US 2022/0412035 A1 Dec. 29, 2022

(30) Foreign Application Priority Data

Nov. 29, 2019 (CN) ..... 201911204245.5

(51) Int. Cl.
*E02D 5/36* (2006.01)
*E02D 5/46* (2006.01)
*E02D 5/48* (2006.01)

(52) U.S. Cl.
CPC ..... *E02D 5/36* (2013.01); *E02D 5/46* (2013.01); *E02D 5/48* (2013.01)

(58) Field of Classification Search
CPC .... E02D 5/36; E02D 5/46; E02D 5/48; E02D 5/44
See application file for complete search history.

(56) References Cited

U.S. PATENT DOCUMENTS

2019/0153692 A1* 5/2019 Han ..... E02D 5/56

FOREIGN PATENT DOCUMENTS

CN 1113528 A 12/1995
CN 101024959 A 8/2007
(Continued)

OTHER PUBLICATIONS

Mar. 11, 2021 Office Action and Search Report issued in Chinese Patent Application No. 201911204245.5.
(Continued)

*Primary Examiner* — Kyle Armstrong
(74) *Attorney, Agent, or Firm* — Oliff PLC

(57) ABSTRACT

A method for the construction of composite under-reamed pile, including: implementing a jet grouting and agitation at a pre-designed position to form a composite cemented-soil foundation; constructing the pile hole with a drilling rig, during which bulb cavities are formed when the pile structure includes bulbs; cleaning the pile hole, lifting down a reinforcing cage, lowering a concrete pouring conduit to the pile hole, and lifting the pouring conduit while pouring the concrete; the hardened concrete becoming a pile stem in the pile hole and a bulb in the bulb cavity. Thus, this construction method can completely eliminate the hole collapse risk at the bulb cavity position during drilling; the combined structure of the bulb and the composite cemented-soil foundation can greatly improve the bearing capacity of pile foundation, significantly reduce the settlement risk and the cost of the pile foundation, as well as shorten construction period.

6 Claims, 6 Drawing Sheets

(56) References Cited

FOREIGN PATENT DOCUMENTS

| | | | | |
|---|---|---|---|---|
| CN | 104988907 | A | | 10/2015 |
| CN | 105350523 | A | | 2/2016 |
| CN | 105714774 | A | | 6/2016 |
| CN | 105804062 | A | | 7/2016 |
| CN | 106087999 | A | | 11/2016 |
| CN | 108729440 | A | | 11/2018 |
| CN | 109778847 | A | | 5/2019 |
| JP | 2001-248156 | A | | 9/2001 |
| JP | 2019-039140 | A | | 3/2019 |
| KR | 101378814 | B1 | * | 3/2014 |
| KR | 20170033728 | A | * | 3/2017 |
| KR | 10-2018-0106061 | A | | 10/2018 |
| WO | 2019/148812 | A1 | | 8/2019 |

OTHER PUBLICATIONS

Sep. 17, 2021 Office Action issued in Chinese Patent Application No. 201911204245.5.

Aug. 19, 2020 Search Report issued in International Patent Application No. PCT/CN2019/126283.

Aug. 19, 2020 Written Opinion of the International Searching Authority issued in International Patent Application No. PCT/CN2019/126283.

* cited by examiner

METHOD FOR CONSTRUCTION OF COMPOSITE UNDER-REAMED PILE AND EQUIPMENT THEREOF

CROSS REFERENCES TO RELATED APPLICATIONS

This application claims priority benefits to Chinese Patent Application No. 201911204245.5, filed 29 Nov. 2019, the contents of which are herein incorporated by reference.

TECHNICAL FIELD

The present invention relates to the construction technology of bored piles in the field of civil engineering, particularly the construction method of composite under-reamed pile and the equipment thereof.

BACKGROUND

Bored piles are widely used in the field of civil engineering construction due to the advantages of easy construction and low cost. To improve the bearing capacity of pile foundations, in the civil engineering practice, there have appeared the technology of cast-in-situ pile with expanded branches and plates, the static pressure grouting technology of pile bottom and pile circumference, etc. However, the above technologies have major inherent defects in practical application. For the technology of the cast-in-situ pile with expanded branches and plates (also known as the squeezed branch and plate pile), there increases the process of re-squeezing and re-expanding the branches and plates after the forming of the pile hole, and hole collapse is easy to occur at the position of bulb cavity; for the grouting technology, the grouting results are uncontrollable, which affects the project quality.

Therefore, although the existing technology can preliminarily improve the bearing capacity of pile foundation in the case of short piles, the construction is complicated and hole collapse at the position of bulb cavity cannot be eliminated.

SUMMARY

In view of this, the present invention provides a method for the construction of composite under-reamed piles and the equipment thereof, so as to solve the above technical problems.

The method for the construction of composite under-reamed piles provided by present invention comprises the following steps:

leveling a construction site, and conducting a survey and setting-out of pile position;

according to a pre-designed pile structure, forming composite cemented-soil foundations by implementing a jet grouting and agitation at pre-designed positions, wherein, the jet grouting and agitation comprises a guniting and agitation at pre-designed pressure or a powder spraying and agitation at pre-designed pressure, the pre-designed position comprises the pre-designed bulb of the pile structure and/or the pile end of the pile structure, wherein said bulb is a specific call of the plate having a bulb-shape in the present invention;

when the composite cemented-soil foundation reaches a pre-designed strength, conducting a repeating survey of the pile position; then, carrying out a pile hole construction with the drilling rig in accordance with the pre-designed pile structure, wherein, when the pre-designed pile structure comprises bulbs, carrying out a bulb cavity-forming at the pre-designed bulb positions;

then cleaning the pile hole, dipping a steel reinforcement cage to and lowering a concrete pouring conduit to the pile hole; lifting the pouring conduit upward while pouring the concrete, so as to the inside of the pile hole and/or the bulb cavities are full-filled with the concrete; the concrete will form a pile stem in the pile hole and the bulb in the bulb cavity after it is hardened.

Alternatively, if the pre-designed pile structure is a single pile structure comprising the bulbs and/or the pile end, the according to the pre-designed pile structure, forming the composite cemented-soil foundations by implementing the jet grouting and agitation at the pre-designed positions, comprising:

if it is the single pile structure comprising at least one bulb, implementing the jet grouting and agitation at each designed bulb position to form at least one composite cemented-soil foundation at the pre-designed bulb position, with each composite cemented-soil foundation corresponding to one bulb position;

and/or, if it is the single pile structure comprising the pile end, implementing the jet grouting and agitation should be carried out at the position of the pile end to form the composite cemented-soil foundation.

Alternatively, if the pre-designed pile structure is a multi-pile or pile group structure comprising the bulbs and/or the pile ends, the according to the pre-designed pile structure, forming the composite cemented-soil foundations by implementing the jet grouting and agitation at the pre-designed positions, comprising:

implementing the jet grouting and agitation at the pre-designed bulb position to form a bulb-position interconnected composite cemented-soil foundation with at least some of the bulb-position composite cemented-soil foundations corresponding to the bulbs at the same elevation;

and/or, implementing the jet grouting and agitation at a pre-designed elevation of the pile end to form a pile-end interconnected composite cemented-soil foundation with at least some of the pile-end composite cemented-soil foundations at the same elevation.

Alternatively, the carrying out the pile hole construction with the drilling rig in accordance with the pre-designed pile structure, wherein, when the pre-designed pile structure comprises bulbs, carrying out the bulb cavity-forming at the pre-designed bulb positions, comprising:

if it is the single pile structure comprising at least one bulb, performing a hole forming and a bulb cavity-forming alternately using the drilling rig and a bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill to the pre-designed depth to finish the hole forming. Thus, there forms the pile hole, with at least one bulb cavity and at least one bulb-position composite cemented-soil foundation distributed along the pile hole; wherein, each the bulb cavity is respectively embedded in the corresponding bulb-position composite cemented-soil foundation thereof;

or, if it is the single pile structure comprising the pile end, performing the hole forming and the bulb cavity-forming alternately using the drilling rig and the bulb cavity former respectively, then drilling to the pre-designed depth within the pile-end composite cemented-soil foundation and finishing the hole forming. Thus, there forms the pile hole, with the composite cemented-soil foundation at the end of the pile hole;

or, if it is the single pile structure comprising at least one bulb and the pile end, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill the hole to the pre-designed depth within the pile-end composite cemented-soil foundation and finishes the hole forming. Thus, there forms the pile hole, with at least one bulb cavity and at least one bulb-position composite cemented-soil foundation along it, and a composite cemented-soil foundation at the end of the pile hole; wherein, each bulb cavity is respectively embedded in the corresponding bulb-position composite cemented-soil foundation thereof.

Alternatively, the carrying out the pile hole construction with the drilling rig in accordance with the pre-designed pile structure, wherein, when the pre-designed pile structure comprises bulbs, carrying out the bulb cavity-forming at the pre-designed bulb positions, comprising:

if it is the multi-pile or pile group structure comprising the bulbs, performing the hole forming using the drilling rig at a position of each single pile. For each the single pile, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill to the pre-designed depth to finish the hole forming. Thus, there form all the pile holes, with at least one bulb cavity and at least one bulb-position interconnected composite cemented-soil foundation along each pile holes, wherein, each bulb cavity is respectively embedded within the corresponding bulb-position interconnected composite cemented-soil foundation;

or, if it is the multi-pile or pile group structure comprising the pile ends, performing the hole forming using the drilling rig at the position of each the single pile. For each the single pile, performing the hole forming and the bulb cavity-forming alternately using the drilling rig and the bulb cavity former respectively, then drilling to the pre-designed depth within the pile-end interconnected composite cemented-soil foundation and finishing the hole forming. Thus, there form the pile hole, with the interconnected composite cemented-soil foundation at the end of the pile hole;

or, if it is a multi-pile or pile group structure comprising the bulbs and the pile ends, the holes are formed using the drilling rig at the position of each the single pile. For each the single pile, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill and form the hole to the pre-designed depth within the pile-end interconnected composite cemented-soil foundation and then finishes the hole forming. Thus, there forms the pile hole, with at least one bulb cavity and at least one bulb-position interconnected composite cemented-soil foundation along each pile hole, and a composite cemented-soil foundation at the end of the pile hole. Wherein, each bulb cavity is respectively embedded in the corresponding interconnected composite cemented-soil foundation.

Alternatively, for the single pile structure comprising at least one bulb, each the bulb-position composite cemented-soil foundation is formed adopting the once-forming mode or the multi-time forming mode. When using the once-forming mode, the bulb-position composite cemented-soil foundation is a single column formed by jet grouting and agitation with the diameter not less than that of the corresponding bulb. When the hole forming is finished, the pile hole is wrapped by the corresponding composite cemented-soil foundation. For the multi-time forming mode, the bulb-position composite cemented-soil foundation is a combination of the columns formed by jet grouting and agitation surrounding the central axis of the pile hole, with each column, whose diameter is not less than that of the corresponding bulb, independent and mutually interlocked with others. After the hole forming is finished, the pile hole is surrounded and wrapped by the composite cemented-soil foundation at the pile positions;

and/or, if it is the single pile structure comprising the pile end, each the pile-end composite cemented-soil foundation is formed by adopting the once-forming mode or the multi-time forming mode. When using the once-forming mode, the pile-end composite cemented-soil foundation is a single column formed by jet grouting and agitation; when using the multi-time forming mode, the pile-end composite cemented-soil foundation is the combination of columns formed by jet grouting and agitation, which are independent and mutually interlocked.

Alternatively, if it is the multi-pile or pile group structure comprising bulbs, each the bulb-position interconnected composite cemented-soil foundation is formed adopting the once-forming mode or the multi-time forming mode. When using the multi-time forming mode, the bulb-position interconnected composite cemented-soil foundation comprises a plurality of the bulb-position composite cemented-soil foundations formed separately at the same elevation and interconnected;

and/or, if it is the multi-pile or pile group structure comprising pile ends, each pile-end interconnected composite cemented-soil foundation is formed by adopting the once-forming mode or the multi-time forming mode. When using the multi-time forming mode, the pile-end interconnected composite cemented-soil foundation comprises a plurality of the pile-end interconnected composite cemented-soil foundations formed separately at the same depth and interconnected.

Alternatively, the bulb cavity surrounds the outside of the pile hole and is coaxial with the pile hole, and they two together form a continuous or discontinuous ring conical cavity and/or ring conical cylindrical cavity;

after the pile is formed, the bulb is respectively embedded in the upper section of the corresponding bulb-position composite cemented-soil foundation and share the vertical coaxial with the it.

Alternatively, the jet grouting and agitation involves grouting a medium at the pre-designed pressure and agitating the soil at the same time. The medium includes slurry medium or powder medium; the jet grouting refers to pressurized jet grouting, including high pressure jet grouting;

a method of constructing the pile hole with the drilling rig comprises a slurry-supported hole forming method and/or a non-slurry-supported hole forming method;

a method of forming the bulb cavity comprises at least one of a rotary cutting, a rotary expanding, and a squeezing.

Further, to achieve the construction purpose mentioned above, the present invention, meanwhile, provides a set of equipment for the construction of composite under-reamed pile, comprising a jet grouting and agitation device, a drilling rig, and a bulb cavity device former; wherein, the jet grouting and agitation device is utilized to carry out jet grouting and agitation at the pre-designed position according to form a composite cemented-soil foundation;

the drilling rig is used to carry out the pile hole construction according to the designed pile structure after the composite cemented-soil foundations have reached the pre-designed strength;

the bulb cavity former is applied to form a bulb cavity at the pre-designed bulb position when the pre-designed pile structure comprises a bulb.

Compared with the prior art, the present invention provides a method for the construction of the composite under-reamed pile: leveling the construction site and carrying out a survey and setting-out of pile position; implementing the jet grouting and agitation at the pre-designed position to form the composite cemented-soil foundation, wherein, the pre-designed position comprises the pre-designed bulb position and/or the position of the pile end of the pile structure; when the composite cemented-soil foundation reaches the pre-designed strength, conducting a repeating survey of the pile position; carrying out the pile-hole construction using the drilling rig, and forming bulb cavities at the pre-designed bulb positions when the designed pile structure comprises bulbs; cleaning the pile hole, and lifting down the reinforcing cage; lowering the concrete pouring conduit to the pile hole, and lifting the pouring conduit accordingly while pouring the concrete, so that the pile hole and/or the bulb cavity can be filled with concrete. Thus, after the concrete hardens, the hardened concrete becomes a pile stem in the pile hole and the bulb in the bulb cavity. Accordingly, the present invention provides a method for the construction of the composite under-reamed pile, which implements jet grouting and agitation at the pre-designed bulb position and/or the pile-end position before the construction of the pile hole, thus completely eliminating the risk of collapse of the hole wall at the bulb cavity position during the drilling process. In addition, the combined structure of the bulb and the composite cemented-soil foundation can greatly improve the bearing capacity of the pile foundation, significantly reduce settlement risk of the pile foundation, lower the cost of the pile foundation and shorten the construction period.

The realization of the purpose, functional characteristics and advantages of the present invention will be further explained by combining the attached drawings with the embodiments.

DETAILED DESCRIPTION

It should be understood that the specific embodiments described herein are intended only to explain the present invention but not to limit it.

Figure 1:
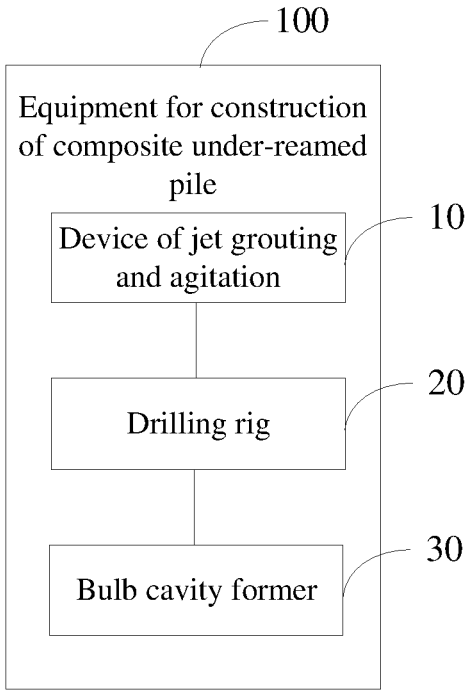
FIG. 1 is a structural schematic diagram of a set of equipment for the construction of the composite under-reamed pile provided by an embodiment of the present invention.

FIG. 1 is a structural schematic diagram of a set of equipment 100 for the construction of a composite under-reamed pile provided by an embodiment of the present invention. Accordingly, the equipment comprises a jet grouting and agitation device 10, a drilling rig 20, and a bulb cavity former 30.

The jet grouting and agitation device 10 is used to implement the jet grouting and agitation to form composite cemented-soil foundation. The jet grouting and agitation comprises a guniting and agitation at pre-designed pressure or a powder spraying and agitation at pre-designed pressure, and further comprises performing a fully agitation to the soil mass while jetting a medium at the pre-designed pressure, wherein, the medium comprises a pre-designed slurry medium or a pre-designed powder medium.

The drilling rig 20 is used for carrying out pile hole construction when the composite cemented-soil foundation reaches a pre-designed strength, comprising one or more types of drilling rigs according to the actual construction site conditions and needs, such as the rotary drilling rig, long screw drilling rig, and slewing drilling machine.

The bulb cavity former 30, used to form bulb cavities at the pre-designed bulb positions, can be a single device or a complete set of devices, according to the conditions and needs of the actual construction site. Based on the type of the bulb cavity former 30, one or more of the three bulb cavity forming modes (rotary, expanding and squeezing) can be applied in the forming process.

Figure 2:
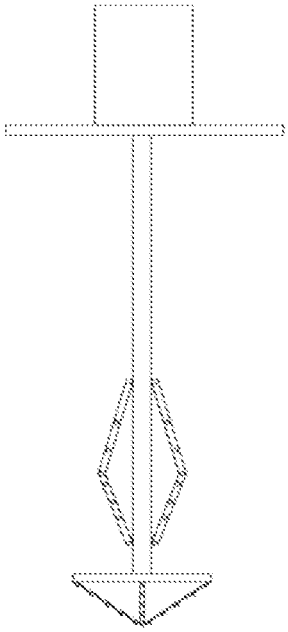
FIG. 2 is a schematic diagram of a drilling and rotary cutting all-in-one machine provided by the embodiment of the present invention.

In some embodiments of the present invention, the drilling rig 20 and the bulb cavity former 30 can integrate and work as a whole. For example, they can combine into the equipment with functions of drilling and cavity forming simultaneously, such as an integrated drilling and rotary cutting machine shown in FIG. 2.

It should be noted that the construction equipment 100 of the composite under-reamed pile is not limited to the equipment mentioned above, so the embodiment of the present invention is not specifically limited in this regard. The following is a detailed description of the construction method of the composite under-reamed pile provided by the present invention with the aid of the corresponding structural schematic diagram mentioned above.

Figure 3:
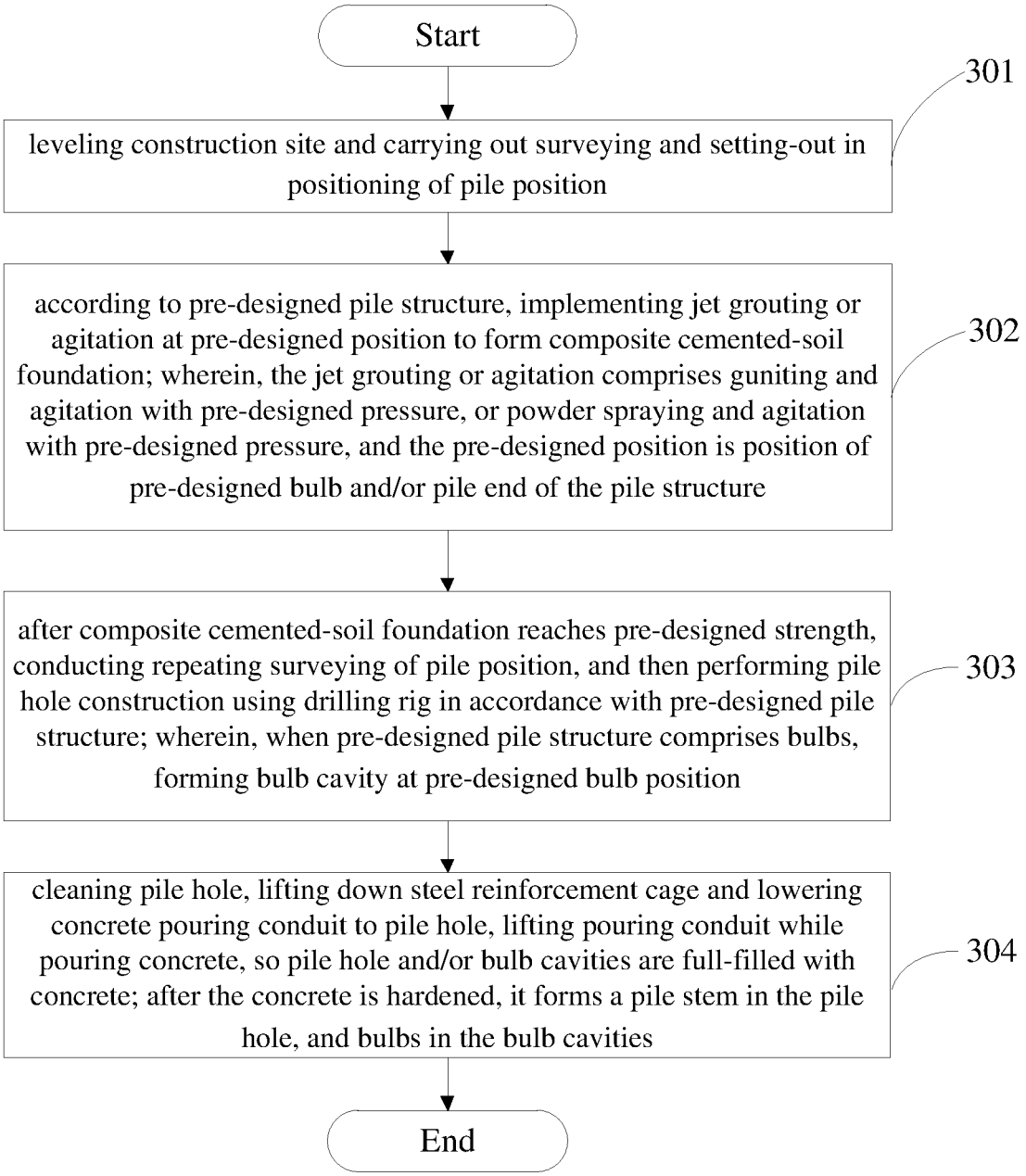
FIG. 3 is a flow diagram of a method for the construction of composite under-reamed pile provided by the embodiment of the present invention.

FIG. 3 is a flow diagram of a method for the construction of composite under-reamed piles provided by the embodiment of the present invention, as shown in FIG. 3, the construction method of the composite under-reamed pile comprises the following steps:

Step 301: leveling the construction site and carrying out a survey and setting-out of pile position.

In this step, carrying out the survey and setting-out of pile positions is to determine the coordinate position of the pre-designed pile.

Step 302: according to the pre-designed pile structure, implementing the jet grouting and agitation at the pre-designed position, wherein, the jet grouting and agitation comprises a guniting and agitation at pre-designed pressure or a powder spraying and agitation at pre-designed pressure, the pre-designed position comprises the pre-designed bulb of the pile structure and/or the pile end of the pile structure.

Wherein, after surveying and positioning and determining a coordinate position of the pile when the coordinates of the pile are designed, according to the pre-designed pile structure, implementing the jet grouting and agitation at the pre-designed position. Wherein, the jet grouting and agitation comprises the guniting and agitation or the powder spraying and agitation at the pre-designed pressure; the pre-designed position is where the jet grouting and agitation is required in the pile structure, for example, the pre-designed bulb of the pile structure and/or the pile end of the pile structure.

The jet grouting and agitation can be carried out using the patented equipment or modified equipment from the existing general ones; jet grouting refers to pressurized jet grouting, including high pressure jet grouting; the jet grouting and agitation can be done adopting one or more of the three modes: rotary spraying, directional spraying, and oscillating spraying, using a single-pipe method or a multi-pipe method, or by other special equipment.

The medium for jet grouting comprises slurry medium and powder medium. The slurry medium is in the slurry state, including but not limited to the following materials: water, compressed gas, cement, cement additives, admixtures, and other media materials; the powder medium is in the powder state, including but not limited to the following materials: cement, cement additives, curing agents, quick-setting agents, and other media materials. The specific conditions, such as an operating point of jet grouting and agitation, a configuration ratio of each material in the medium for jet grouting, a jet volume, a jet pressure, a jet radius and range, an interlocking and stacking ratio of jet grouting, and a lifting/descending speed and a rotation speed of the jet grouting and agitation device, can all be preset or pre-determined according to the actual construction conditions, e.g., the actual physical properties of the soil body. The present invention does not limit the construction details such as the jet method or materials of the jet grouting and agitation, as long as the actual results of the jet grouting meet the pre-designed requirements of the composite cemented-soil foundation.

The pre-designed pile structure can be a single pile structure or a multi-pile or pile group structure, which comprises the bulbs or the pile ends, or both of them.

When it is a single pile structure comprising at least one bulb, the bulb-position composite cemented-soil foundation is formed by implementing the jet grouting and agitation at each the pre-designed bulb position of the single pile structure, with each bulb-position composite cemented-soil foundation corresponding to one bulb position. It can be understood that one single pile structure may comprise one or more bulbs, with the number of the bulb-position composite cemented-soil foundations the same as that of the bulbs, and each bulb-position composite cemented-soil foundation corresponding to one bulb position. The construction process and dimensions (e.g., radius and thickness) of each bulb-position composite cemented-soil foundation can be implemented according to pre-designed parameters. It can be understood that for the single pile structure comprising a plurality of bulbs, the construction process and dimensions of the bulb-position composite cemented-soil foundations corresponding to the bulbs can be the same or not. The bulb-position composite cemented-soil foundation can be constructed in a once-forming or a multi-time forming mode, and the embodiment of the present invention is not specifically limited in this regard. In some embodiments of the present invention, the dimensions of the bulb-position composite cemented-soil foundation can be determined according to those of the corresponding bulbs thereof. Specifically, the diameter of the bulb-position composite cemented-soil foundation is not less than that of the corresponding bulb thereof.

When it is a single pile structure comprising the pile end, the pile-end composite cemented-soil foundation is formed by implementing jet grouting and agitation at the pre-designed elevation of the pile end. It can be understood that as a single pile comprises only one pile end, when the single pile structure comprises only the pile end, the number of the pile-end composite cemented-soil foundation is 1. The construction process and dimensions (e.g., diameter and thickness) of the pile-end composite cemented-soil foundation can be implemented according to pre-designed parameters. The pile-end composite cemented-soil foundation can be formed in once-forming mode or the multi-time forming mode, and herein the embodiments of the present invention are not specifically limited in this regard. In some embodiments of the present invention, the dimensions of the pile-end composite cemented-soil foundation can be determined according to the dimension of the pile hole. Specifically, the diameter of the pile-end composite cemented-soil foundation is more than 1 meter larger than that of the pile hole; the thickness of the pile-end composite cemented-soil foundation is more than 1 meter; the bottom surface of the pile-end composite cemented-soil foundation is more than 0.5 meters below the bottom of the pile hole.

When it is a single pile structure comprising both at least one bulb and the pile end, the construction process of the bulb-position composite cemented-soil foundation can be same as that of the bulb-position composite cemented-soil foundation in the case of the single pile structure with at least one bulb described above, and the construction process of the pile-end composite cemented-soil foundation can be same as that of the pile-end composite cemented-soil foundation in the case of the single pile structure comprising the pile end described above. Therefore, it is not repeated herein.

When it is a multi-pile or pile group structure comprising at least one bulb, the bulb-position interconnected composite cemented-soil foundation is formed by implementing the jet grouting and agitation at the pre-designed bulb positions, and is interconnected with the bulb-position composite cemented-soil foundations corresponding to at least some of the bulbs at the same elevation. The "at least some of the bulbs at the same elevation" means some of the bulbs or all the bulbs at the same elevation, i.e., each bulb-position interconnected composite cemented-soil foundation comprises all or some of the bulb-position interconnected composite cemented-soil foundations at the same elevation. Besides, the all or some of the bulb-position composite cemented-soil foundation are interconnected. The construction process and dimensions (e.g., radius and thickness) of the bulb-position interconnected composite cemented-soil foundation can be implemented according to pre-designed parameters. The bulb-position interconnected composite cemented-soil foundation can be formed in once-forming mode or the multi-time forming mode. When adopting the once-forming mode, the multiple bulb-position composite cemented-soil foundations included therein can be formed jointly; when adopting the multi-time forming mode, the multiple bulb-position composite cemented-soil foundations included therein can be formed individually in either of the two modes, or they can be combined and further formed in either of the two modes, and the embodiments of the present invention are not specifically limited in this regard. In some embodiments of the present invention, the dimensions of each bulb-position composite cemented-soil foundation can be determined according to those of the corresponding bulb thereof. Specifically, the diameter of the bulb-position composite cemented-soil foundation is not less than that of the corresponding bulb thereof. The number and the interconnection form of the bulb-position composite cemented-soil foundations included in the bulb-position interconnected composite cemented-soil foundation can be pre-designed.

When it is a multi-pile or pile group structure comprising the pile ends, implementing the jet grouting and agitation at the pre-designed elevation of the pile end, so as to form the pile-end interconnected composite cemented-soil foundation interconnected with at least some of the pile-end composite cemented-soil foundations at the same elevation. Each pile-end interconnected composite cemented-soil foundation comprises all or some of the pile-end interconnected composite cemented-soil foundations at the same elevation, and the all or some of the pile-end composite cemented-soil foundations are interconnected. The construction process and dimensions (e.g., radius and thickness) of the pile-end composite cemented-soil foundations can be implemented according to pre-designed parameters. The pile-end interconnected cemented-soil foundations can be formed in once-forming mode or the multi-time forming mode. When adopting the once-forming mode, the multiple pile-end composite cemented-soil foundations included therein can be formed jointly; when adopting the multi-time forming mode, the multiple pile-end composite cemented-soil foundations included therein can be formed individually in either of the two forms, or combined and further formed in either of the two forms. The embodiments of the present invention are not specifically limited in this regard. In some embodiments of the present invention, the dimensions of each pile-end composite cemented-soil foundation can be determined according to those of the corresponding pile hole thereof. Specifically, the diameter of the pile-end composite cemented-soil foundation is more than 1 meter larger than that of the corresponding pile hole thereof; the thickness of the pile-end composite cemented-soil foundation is more than 1 meter; the bottom surface of the pile-end composite cemented-soil foundation is more than 0.5 meter below the bottom of the pile hole. The number and the interconnection form of the pile-end composite cemented-soil foundations which are included in the pile-end interconnected composite cemented-soil foundation can be pre-designed.

When it is a multi-pile or pile group structure comprising both the bulbs and the pile ends, the construction process of the bulb-position interconnected composite cemented-soil foundation may be the same as that of the bulb-position interconnected composite cemented-soil foundation in the case of the multi-pile or pile group structure with the bulbs; the construction process of the pile-end interconnected composite cemented-soil foundation may be the same as that of the pile-end interconnected composite cemented-soil foundation in the case of the multi-pile or pile group structure comprising the pile end. Therefore, it is not repeated herein.

Step 303: when the composite cemented-soil foundation reaches a pre-designed strength, conducting a repeating survey of the pile position; then, carrying out a pile hole construction with the drilling rig in accordance with the pre-designed pile structure, wherein, when the pre-designed pile structure comprises bulbs, carrying out a bulb cavity-forming at the pre-designed bulb positions.

When the composite cemented-soil foundation reaches a pre-designed strength, conducting a repeating survey of the pile position; then, carrying out a pile hole construction with the drilling rig in accordance with the pre-designed pile structure, wherein, when the pre-designed pile structure comprises bulbs, carrying out a bulb cavity-forming at the pre-designed bulb positions. The repeating survey of the pile position can be carried out before the composite cemented-soil foundation reaches the pre-designed strength, or after the composite cemented-soil foundation reaches the pre-designed strength, on which the embodiments of the present invention do not make a specific limitation.

When it is the single pile structure comprising at least one bulb, performing a hole forming and a bulb cavity-forming alternately using the drilling rig and a bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill to the pre-designed depth to finish the hole forming. Thus, there forms the pile hole, with at least one bulb cavity and one bulb-position composite cemented-soil foundation distributed along the pile hole; wherein, each bulb cavity is respectively embedded in the corresponding bulb-position composite cemented-soil foundation thereof.

When it is the single pile structure comprising the pile end, performing the hole forming and the bulb cavity-forming alternately using the drilling rig and the bulb cavity former respectively, then drilling to the pre-designed depth within the pile-end composite cemented-soil foundation and finishing the hole forming. Thus, there forms the pile hole, with the pile-end composite cemented-soil foundation at the end of it.

When it is the single pile structure comprising at least one bulb and the pile end, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill to the pre-designed depth within the pile-end composite cemented-soil foundation and then finishes the hole forming. Thus, there forms the pile hole, with at least one bulb cavity and at least one bulb-position composite cemented-soil foundation distributed along it, and a composite cemented-soil foundation distributed at the end of it, wherein, each bulb cavity is respectively embedded in the corresponding bulb-position composite cemented-soil foundation thereof.

When it is the multi-pile or pile group structure comprising the bulbs, the drilling rig drills and forms the holes at the position of each the single pile of the multi-pile or pile group structure. For each the single pile, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill to the pre-designed depth to finish the hole forming. Thus, there form the pile holes, with at least one bulb cavity and at least one bulb-position interconnected composite cemented-soil foundation distributed along each pile hole, wherein, each bulb cavity is respectively embedded within the corresponding bulb-position interconnected composite cemented-soil foundation thereof.

When it is the multi-pile or pile group structure comprising the pile end, the drilling rig drills and forms the hole at the position of each the single pile. For each the single pile, performing the hole forming and the bulb cavity-forming alternately using the drilling rig and the bulb cavity former respectively, then drilling to the pre-designed depth within the pile-end interconnected composite cemented-soil foundation of the single pile and then finishing the hole forming. Thus, there forms the pile hole, with the pile-end interconnected composite cemented-soil foundation distributed at the end of it.

When it is the multi-pile or pile group structure comprising the bulbs and the pile ends, the drilling rig forms and drills the hole at the position of each the single pile. For each the single pile, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill and form the hole to the pre-designed depth within the pile-end interconnected composite cemented-soil foundation and then finishes the hole forming. Thus, there forms the pile hole, with at least one bulb cavity and at least one bulb-position interconnected composite cemented-soil foundation along each pile hole, and the pile-end composite cemented-soil foundation distributed at the end of the pile hole. In the structure, each bulb cavity is respectively embedded in the corresponding bulb-position interconnected composite cemented-soil foundation thereof.

Step 304: cleaning the pile hole, dipping a steel reinforcement cage to and lowering a concrete pouring conduit to the pile hole, then lifting the pouring conduit upward while pouring the concrete, so as to the inside of the pile hole and/or the bulb cavities are full-filled with the concrete; the concrete will form a pile stem in the pile hole and the bulb in the bulb cavity after it is hardened.

Cleaning the pile hole, dipping the steel reinforcement cage to and lowering the concrete pouring conduit to the pile hole, then lifting the pouring conduit upward while pouring the concrete, so as to the inside of the pile hole and/or the bulb cavities are full-filled with the concrete; the concrete will form the pile stem in the pile hole and the bulb in the bulb cavity after it is hardened.

Figure 4:
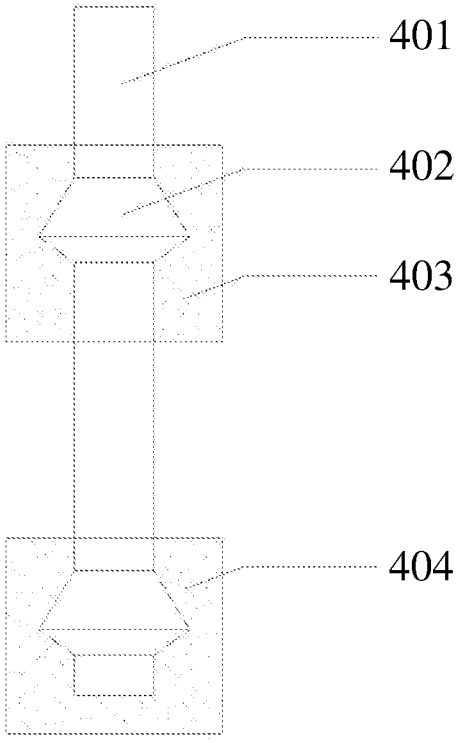
FIG. 4 is a schematic diagram of a single pile structure provided by the embodiment of the present invention.

For example, to the single pile structure comprising at least one bulb and the pile end, the structural schematic diagram thereof after the completion of construction is shown in FIG. 4, comprising the pile 401, the bulb 402, the bulb-position composite cemented-soil foundation 403, and the pile-end composite cemented-soil foundation 404.

Figure 5:
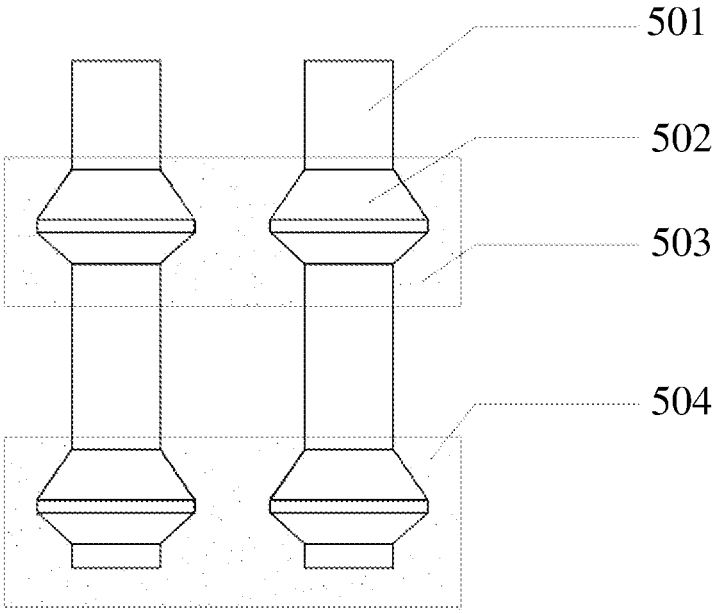
FIG. 5 is a schematic diagram of a multi-pile or pile group structure provided by the embodiment of the present invention.

For the multi-pile or pile group structure comprising bulbs and the pile end, the structural schematic diagram thereof after the completion of construction is shown in FIG. 5, comprising the pile 501, the bulb 502, the bulb-position interconnected composite cemented-soil foundation 503, and the pile-end interconnected composite cemented-soil foundation 504.

In the embodiment of the present invention, before finishing the hole forming, the bulb-position composite cemented-soil foundation is formed through jet grouting and agitation at the pre-designed bulb position, and then the bulb cavity is formed when the bulb-position composite cemented-soil foundation reaches the pre-designed strength. Thus, during the forming of the bulb cavity, collapse of the hole wall can be avoided as the surrounding soil of the composite cemented-soil foundation has reached the pre-designed strength.

In the present embodiment, the method for the construction of the composite under-reamed pile comprises: leveling the construction site, and conducting a survey and setting-out of pile position; according to a pre-designed pile structure, forming composite cemented-soil foundations by implementing a jet grouting and agitation at pre-designed positions, wherein, the pre-designed position comprises the pre-designed bulb of the pile structure and/or the pile end of the pile structure; when the composite cemented-soil foundation reaches the pre-designed strength, conducting the repeating survey of the pile position; then, carrying out the pile hole construction with the drilling rig in accordance with the pre-designed pile structure, wherein, when the pre-designed pile structure comprises bulbs, carrying out the bulb cavity-forming at the pre-designed bulb positions; cleaning the pile hole, dipping a steel reinforcement cage to and lowering a concrete pouring conduit to the pile hole; lifting the pouring conduit upward while pouring the concrete, so as to the inside of the pile hole and/or the bulb cavities are full-filled with the concrete; the concrete will form a pile stem in the pile hole and the bulb in the bulb cavity after it is hardened. Accordingly, the present invention, which provides the method for the construction of the composite under-reamed pile through implementing jet grouting and agitation at the pre-designed bulb position and/or the pile-end position before the construction of the pile hole, can completely eliminate the collapse risk of the hole wall at the bulb cavity position during the drilling process. In addition, the combined structure of the bulb and the composite cemented-soil foundation can greatly improve the bearing capacity of the pile foundation, significantly reduce the settlement of the pile foundation, lower the cost of the pile foundation and shorten the construction period.

Alternatively, if the pre-designed pile structure is the single pile structure comprising the bulb and/or the pile end, the according to the pre-designed pile structure, forming the composite cemented-soil foundations by implementing the jet grouting and agitation at the pre-designed positions, comprising:

if it is the single pile structure comprising at least one bulb, implementing the jet grouting and agitation at each the pre-designed bulb position to form at least one composite cemented-soil foundation at the pre-designed bulb position, with each composite cemented-soil foundation corresponding to one bulb position;

and/or, if it is the single pile structure comprising the pile end, implementing the jet grouting and agitation should be carried out at the position of the pile end to form the composite cemented-soil foundation.

Alternatively, if the pre-designed pile structure is a multi-pile or pile group structure comprising the bulbs and/or the pile ends, the according to the pre-designed pile structure, forming the composite cemented-soil foundations by implementing the jet grouting and agitation at the pre-designed positions, comprising:

implementing the jet grouting and agitation at the pre-designed bulb position to form a bulb-position interconnected composite cemented-soil foundation with at least some of the bulb-position composite cemented-soil foundations corresponding to the bulbs at the same elevation;

and/or, implementing the jet grouting and agitation at a pre-designed elevation of the pile end to form a pile-end interconnected composite cemented-soil foundation with at least some of the pile-end composite cemented-soil foundations at the same elevation.

Alternatively, the carrying out the pile hole construction with the drilling rig in accordance with the pre-designed pile structure, wherein, when the pre-designed pile structure comprises bulbs, carrying out the bulb cavity-forming at the pre-designed bulb positions, comprising:

if it is the single pile structure comprising at least one bulb, performing a hole forming and a bulb cavity-forming alternately using the drilling rig and a bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill to the pre-designed depth to finish the hole forming. Thus, there forms the pile hole, with at least one bulb cavity and at least one bulb-position composite cemented-soil foundation distributed along the pile hole; wherein, each the bulb cavity is respectively embedded in the corresponding bulb-position composite cemented-soil foundation thereof;

or, if it is the single pile structure comprising the pile end, performing the hole forming and the bulb cavity-forming alternately using the drilling rig and the bulb cavity former respectively, then drilling to the pre-designed depth within the pile-end composite cemented-soil foundation and finishing the hole forming. Thus, there forms the pile hole, with the composite cemented-soil foundation at the end of the pile hole;

or, if it is the single pile structure comprising at least one bulb and the pile end, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill the hole to the pre-designed depth within the pile-end composite cemented-soil foundation and finishes the hole forming. Thus, there forms the pile hole, with at least one bulb cavity and at least one bulb-position composite cemented-soil foundation along it, and a composite cemented-soil foundation at the end of the pile hole; wherein, each bulb cavity is respectively embedded in the corresponding bulb-position composite cemented-soil foundation thereof.

Alternatively, the carrying out the pile hole construction with the drilling rig in accordance with the pre-designed pile structure, wherein, when the pre-designed pile structure comprises bulbs, carrying out the bulb cavity-forming at the pre-designed bulb positions, comprising:

if it is the multi-pile or pile group structure comprising the bulbs, performing the hole forming using the drilling rig at a position of each single pile. For each the single pile, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill to the pre-designed depth to finish the hole forming. Thus, there form all the pile holes, with at least one bulb cavity and at least one bulb-position interconnected composite cemented-soil foundation along each pile holes, wherein, each bulb cavity is respectively embedded within the corresponding bulb-position interconnected composite cemented-soil foundation;

or, if it is the multi-pile or pile group structure comprising the pile ends, performing the hole forming using the drilling rig at the position of each the single pile. For each the single pile, performing the hole forming and the bulb cavity-forming alternately using the drilling rig and the bulb cavity former respectively, then drilling to the pre-designed depth within the pile-end interconnected composite cemented-soil foundation and finishing the hole forming. Thus, there form the pile hole, with the interconnected composite cemented-soil foundation at the end of the pile hole;

or, if it is a multi-pile or pile group structure comprising the bulbs and the pile ends, the holes are formed using the drilling rig at the position of each the single pile. For each the single pile, performing the hole forming and the bulb cavity-forming alternately using the drilling rig and the bulb cavity former respectively, i.e., when the drilling rig reaches the pre-designed bulb position, stopping the drilling and performing the bulb cavity-forming by using the bulb cavity former which being moved away after the bulb cavity-forming is complete, and the drilling rig continues to drill, and repeating the hereinabove process of the bulb cavity-forming till the forming of all the bulb cavities is completed, so there the bulb cavity being formed at each the pre-designed bulb position; then the drilling rig continues to drill and form the hole to the pre-designed depth within the pile-end interconnected composite cemented-soil foundation and then finishes the hole forming. Thus, there forms the pile hole, with at least one bulb cavity and at least one bulb-position interconnected composite cemented-soil foundation along each pile hole, and a composite cemented-soil foundation at the end of the pile hole. Wherein, each bulb cavity is respectively embedded in the corresponding interconnected composite cemented-soil foundation.

Figure 6:
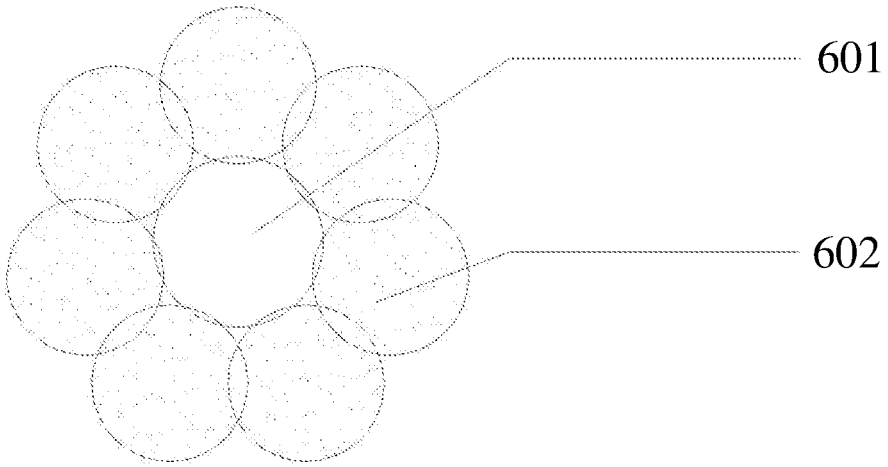
FIG. 6 is an interface diagram of a composite cemented-soil foundation formed in multi-time forming method provided by the embodiment of the present invention.

Alternatively, if it is the single pile structure comprising at least one bulb, each the bulb-position composite cemented-soil foundation is formed adopting the once-forming mode or the multi-time forming mode. When using the once-forming mode, the bulb-position composite cemented-soil foundation is a single column formed by jet grouting and agitation with a diameter not less than that of the corresponding bulb thereof, and after finishing the hole forming, the pile hole is wrapped by the bulb-position composite cemented-soil foundation; when using the multi-time forming mode, the bulb-position composite cemented-soil foundation is a combination of columns formed by jet grouting and agitation surrounding the central axis of the pile hole, which are independent and mutually interlocked. As shown in FIG. 6, the bulb-position composite cemented-soil foundation includes a plurality of columns 602 formed by jet grouting and agitation surrounding the central axis of the pile hole 601. The outer diameter of the combination is not less than that of the corresponding bulb thereof; after finishing the hole forming, the pile hole is wrapped by the bulb-position composite cemented-soil foundation. Each bulb cavity is respectively embedded in the upper section of the corresponding bulb-position composite cemented-soil foundation thereof, and the bulb cavity, the pile hole and the bulb-composite cemented-soil foundation share the same vertical coaxial;

and/or, if it is the single pile structure comprising the pile end, each the pile-end composite cemented-soil foundation is formed by adopting the once-forming mode or the multi-time forming mode. When using the once-forming mode, the pile-end composite cemented-soil foundation is a single column formed by jet grouting and agitation; when using the multi-time forming mode, the pile-end composite cemented-soil foundation is the combination of columns formed by jet grouting and agitation, which are independent and mutually interlocked.

Alternatively, if it is the multi-pile or pile group structure comprising bulbs, each the bulb-position interconnected composite cemented-soil foundation is formed adopting the once-forming mode or the multi-time forming mode. When using the multi-time forming mode, the bulb-position interconnected composite cemented-soil foundation comprises a plurality of the bulb-position composite cemented-soil foundations formed separately at the same elevation and interconnected;

and/or, if it is the multi-pile or pile group structure comprising pile ends, each pile-end interconnected composite cemented-soil foundation is formed by adopting the once-forming mode or the multi-time forming mode. When using the multi-time forming mode, the pile-end interconnected composite cemented-soil foundation comprises a plurality of the pile-end interconnected composite cemented-soil foundations formed separately at the same depth and interconnected.

Alternatively, the bulb cavity surrounds the outside of the pile hole and is coaxial with the pile hole, and they two together form a continuous or discontinuous ring conical cavity and/or ring conical cylindrical cavity;

after the pile is formed, the bulb is respectively embedded in the upper section of the corresponding bulb-position composite cemented-soil foundation and they have the same vertical coaxial.

Alternatively, the jet grouting and agitation involves grouting a medium at the pre-designed pressure and agitating the soil at the same time. The medium includes slurry medium or powder medium; the jet grouting refers to pressurized jet grouting, including high pressure jet grouting;

a method of constructing the pile hole with the drilling rig comprises a slurry-supported hole forming method and/or a non-slurry-supported hole forming method;

a method of forming the bulb cavity comprises at least one of a rotary cutting, a rotary expanding, and a squeezing.

It should be noted that in this paper, the terms "comprise", "comprising", "include", "including" or any other variation thereof are intended to cover nonexclusive inclusion, so that a process, method, article or device including a series of elements includes not only those elements, but also others not explicitly listed, or those inherent in the process, method, article or device. Without further restrictions, the element defined by "comprising a . . . " does not exclude the existence of other same element in the process, method, article or device.

The above serial numbers of the embodiments of the present invention are only for the order of description, which means these embodiments are of the same significance.

Through the description of the above embodiments, those skilled in the art may clearly understand that the above embodiments can be realized through software plus the necessary general hardware platform. Of course, it can also be implemented by hardware, but in many cases the former is the optimal way. Based on this understanding, the essence of the technical scheme of the invention, or the part contributing to the existing technology, can be manifested in the form of a software product. The computer software products can be stored in a storage medium (such as ROM/RAM, disk, and CD-ROM), with several instructions for the implementation of the methods described in each embodiment of the present invention using a terminal device (can be mobile phones, computers, servers, air conditioner, or network equipment, etc.).

The above are merely the preferred embodiments of the present invention and do not limit the patent scope of the present invention. All equivalent structure or equivalent process transformations using the contents of the description or the attached drawings of the present invention, directly or indirectly applied in other relevant technical fields, are similarly included in the patent protection scope of the present invention.

What is claimed is:

1. A method for constructing a composite under-reamed pile, the method comprising:

leveling a construction site and carrying out a survey for a position of a pile and a setting-out for positioning;

forming, according to a pre-designed structure of the pile and through a jet grouting and agitation technology, composite cemented-soil foundations at pre-determined depths at the position of the pile, wherein:

the jet grouting and agitation technology comprises grouting, with a pre-determined pressure, a medium to a soil of the construction site, and agitating the soil simultaneously, wherein the medium comprises a slurry medium or a powder medium; and the pre-determined depths comprise a depth position corresponding to a bulb in the pre-designed structure and/or a depth position corresponding to a pile end in the pre-designed structure;

carrying out the survey again for the position of the pile after each of the composite cemented-soil foundations reaches a pre-determined strength;

forming a pile hole for the pile in accordance with the pre-designed structure of the pile, wherein when the pre-designed structure comprises bulbs, forming a bulb cavity inside each of the formed composite cemented-soil foundations corresponding to the bulbs; and cleaning the pile hole, dipping a steel reinforcement cage and lowering a concrete pouring conduit into the pile hole, then lifting the pouring conduit upward along the pile hole while pouring the concrete, so that the inside of the pile hole and/or each of the bulb cavity are full-filled with the concrete, and then obtaining a pile body in the pile hole and the bulbs in each bulb cavity after the concrete is hardened;

wherein when the pre-designed structure comprises a structure containing a single pile body, the forming the composite cemented-soil foundations at the pre-determined depths at the position of the pile according to the pre-designed structure, comprising:

when the single pile body comprises at least one bulb, forming at least one bulb-position composite cemented-soil foundation at the pre-determined depth corresponding to the bulb, wherein each bulb-position composite cemented-soil foundation corresponds to the depth position of one the bulb; and when the single pile body comprises the pile end, forming one pile-end composite cemented-soil foundation at the pre-determined depth corresponding to the pile end, wherein the pre-determined depth corresponding to the pile end is a position of a pre-determined elevation of the pile end of the single pile body;

wherein when the pre-designed structure comprises a structure containing multiple pile bodies, the forming the composite cemented-soil foundations at the pre-determined depths at the position of the pile according to the pre-designed structure, comprising:

when at least two individual pile bodies in the multiple pile bodies comprise at least one bulb respectively, forming the bulb-position composite cemented-soil foundation at the pre-determined depth corresponding to each bulb, wherein formed bulb-position composite cemented-soil foundations at pre-determined depths corresponding to bulbs with a same pre-determined elevation form a bulb-position interconnected composite cemented-soil foundation by an interconnection therebetween; and when at least two individual pile bodies in the multiple pile bodies comprise the pile end respectively, forming the pile-end composite cemented-soil foundation at the pre-determined depth corresponding to each the pile end, wherein formed pile-end composite cemented-soil foundations at pre-determined depths corresponding to pile ends with the same pre-determined elevation form a pile-end interconnected composite cemented-soil foundation by an interconnection therebetween;

wherein the forming the pile hole for the pile in accordance with the pre-designed structure of the pile, comprising:

for the single pile body comprising at least one bulb, forming the pile hole by using a drilling rig and forming the bulb cavity in the bulb-position composite cemented-soil foundation by using a bulb cavity former alternately, and completing the pile hole until the drilling rig reaches an end of the single pile body after all bulb cavities being formed completely, obtaining the pile hole, and at least one the bulb cavity and at least one the bulb-position composite cemented-soil foundation distributed along the pile hole, wherein each bulb cavity being respectively embedded in a corresponding bulb-position composite cemented-soil foundation thereof;

for the single pile body comprising the pile end, forming the pile hole by using the drilling rig, drilling and reaching to a pre-determined depth inside the pile-end composite cemented-soil foundation and completing the pile hole, and obtaining the pile hole and the pile-end composite cemented-soil foundation distributed at the end of the pile hole; and for the single pile body comprising at least one the bulb and the pile end, forming the pile hole by using the drilling rig and forming the bulb cavity in the bulb-position composite cemented-soil foundation by using the bulb cavity former alternately, and drilling and reaching to the pre-determined depth inside the pile-end composite cemented-soil foundation after all the bulb cavities being formed completely, and then completing the pile hole, obtaining the pile hole, at least one the bulb cavity and at least one the bulb-position composite cemented-soil foundation distributed along the pile hole, and the pile-end composite cemented-soil foundation distributed at the end of the pile hole, wherein each bulb cavity being respectively embedded in a corresponding bulb-position composite cemented-soil foundation thereof; and wherein the forming the pile hole for the pile in accordance with the pre-designed structure of the pile, further comprising:

for the at least two individual pile bodies in the multiple pile bodies comprise at least one the bulb respectively, forming the pile hole for each individual pile body in the multiple pile bodies, wherein for the individual pile body, forming the pile hole by using the drilling rig and forming the bulb cavity in the bulb-position composite cemented-soil foundation, if the individual pile body has at least one the bulb, by using the bulb cavity former alternately, and completing the pile hole till the drilling rig reaches an end of the individual pile body after all bulb cavities being formed completely, obtaining the pile hole, and at least one the bulb cavity and at least one the bulb-position interconnected composite cemented-soil foundation distributed along the pile hole, wherein each bulb cavity being respectively embedded in a corresponding bulb-position interconnected composite cemented-soil foundation thereof;

for the at least two individual pile bodies in the multiple pile bodies comprise the pile end respectively, forming the pile hole for each the individual pile body in the multiple pile bodies, wherein for the individual pile body, forming the pile hole by using the drilling rig, drilling and reaching to the pre-determined depth inside the pile-end interconnected composite cemented-soil foundation and completing the pile hole, and obtaining the pile hole and the pile-end interconnected composite cemented-soil foundation distributed at the end of the pile hole; and for the at least two individual pile bodies in the multiple pile bodies comprise at least one the bulb and the pile end respectively, forming the pile hole for each the individual pile body in the multiple pile bodies, wherein for the individual pile body, forming the pile hole by using the drilling rig and forming the bulb cavity in the bulb-position composite cemented-soil foundation, if the individual pile body has the at least one the bulb, by using the bulb cavity former alternately, and completing the pile hole by drilling and reaching to the pre-determined depth inside the pile-end interconnected composite cemented-soil foundation after all bulb cavities being formed completely, obtaining the pile hole, at least one the bulb cavity and at least one the bulb-position interconnected composite cemented-soil foundation distributed along the pile hole, and the pile-end interconnected composite cemented-soil foundation distributed at the end of the pile hole, wherein each bulb cavity being respectively embedded in a corresponding bulb-position interconnected composite cemented-soil foundation thereof; and wherein the forming the pile hole by using the drilling rig and forming the bulb cavity in the bulb-position composite cemented-soil foundation by using the bulb cavity former alternately, comprising: firstly, drilling the pile hole by using the drilling rig, when the drilling rig reaches inside the bulb-position composite cemented-soil foundation, stopping and removing the drilling rig, forming the bulb cavity inside bulb-position composite cemented-soil foundation by using the bulb cavity former, after the bulb cavity is formed, stopping and removing the bulb cavity former, continuing to drill the pile hole by using drilling rig, repeating the above steps if there are more than one the bulb cavity need to be formed inside corresponding bulb-position composite cemented-soil foundation thereof, until all the bulb cavities are formed completely.

2. The method according to claim 1, wherein, for the single pile body, forming the bulb-position composite cemented-soil foundation by a once-forming or a multi-time forming, comprising:

when using the once-forming, the bulb-position composite cemented-soil foundation being a single column with a diameter not less than that of the corresponding bulb thereof, and after completing the pile hole, the pile hole being wrapped by the bulb-position composite cemented-soil foundation; and when using the multi-time forming, the bulb-position composite cemented-soil foundation being a combination of columns surrounding a central axis of the pile hole;

wherein, the combination of columns comprises a plurality of columns being independent and mutually interlocked, an outer diameter of the combination of columns is not less than that of corresponding bulb thereof, and after completing the pile hole, the pile hole is surrounded and wrapped by the bulb-position composite cemented-soil foundation; and for the single pile body, forming the pile-end composite cemented-soil foundation by the once-forming or the multi-time forming mode, wherein:

when using the once-forming, the pile-end composite cemented-soil foundation is a single column; and when using the multi-time forming, the pile-end composite cemented-soil foundation being a combination of columns comprising a plurality of the columns being independent and mutually interlocked.

3. The method according to claim 1, wherein, for the multiple pile bodies, forming each the bulb-position interconnected composite cemented-soil foundation by a once-forming or a multi-time forming, comprising:

when using the multi-time forming, the bulb-position interconnected composite cemented-soil foundation comprises a plurality of the bulb-position composite cemented-soil foundations at the same elevation and being interconnected therebetween, wherein, each of the plurality of the bulb-position composite cemented-soil foundations is formed separately; and for the multiple pile bodies, forming the pile-end interconnected composite cemented-soil foundations by the once-forming or the multi-time forming, wherein:

when using the multi-time forming, the pile-end interconnected composite cemented-soil foundation comprises a plurality of the pile-end interconnected composite cemented-soil foundations at the same elevation and being interconnected therebetween; and each of the plurality of the pile-end interconnected composite cemented-soil foundations is formed separately.

4. The method according to claim 1, wherein:

the bulb cavity wraps an outside of the pile hole and being coaxial with the pile hole, and the bulb cavity is a continuous or discontinuous ring conical cavity and/or a ring conical cylindrical cavity that is communicated with the pile hole as a whole; and after the pile is formed, each the bulb is embedded inside the corresponding bulb-position composite cemented-soil foundation thereof and is wrapped by the corresponding bulb-position composite cemented-soil foundation, wherein each the bulb is in vertical coaxial relationship with the corresponding bulb-position composite cemented-soil foundation thereof.

5. The method for the construction of composite under-reamed pile according to claim 1, wherein:

the jet grouting and agitation technology further comprises a process of jet grouting refers to pressurized jet grouting including high pressure jet grouting;

a method of constructing the pile hole using the drilling rig comprises a slurry-supported hole forming method and/or a non-slurry-supported hole forming method; and a method of forming the bulb cavity comprises at least one of a rotary cutting, a rotary expanding, and a squeezing.

6. Equipment used in the method according to claim 1, comprising:

a jet grouting and agitation device that is configured to form the composite cemented-soil foundation at the pre-determined depth according to the pre-designed structure of the pile by implementing the jet grouting and agitation technology, wherein:

the drilling rig is configured to drill the pile hole according to the pre-designed structure of the pile after the composite cemented-soil foundation has reached the pre-determined strength; and the bulb cavity former is configured to form the bulb cavity inside the bulb-position composite cemented-soil foundation when the pre-designed structure of the pile comprises the bulbs.

* * * * *